US007514061B2

(12) United States Patent
Sandberg et al.

(10) Patent No.: US 7,514,061 B2
(45) Date of Patent: Apr. 7, 2009

(54) METHOD OF MAKING SUBMICRON CEMENTED CARBIDE

(75) Inventors: Rickard Sandberg, Vaxholm (SE); Mathias Tillman, Hägersten (SE); Mats Waldenström, Bromma (SE)

(73) Assignee: Sandvik Intellectual Property Aktiebolag, Sandviken (SE)

( * ) Notice: Subject to any disclaimer, the term of this patent is extended or adjusted under 35 U.S.C. 154(b) by 490 days.

(21) Appl. No.: 10/833,187

(22) Filed: Apr. 28, 2004

(65) Prior Publication Data

US 2005/0036934 A1 Feb. 17, 2005

(30) Foreign Application Priority Data

Aug. 12, 2003 (SE) ..... 0302199

(51) Int. Cl.
*C01B 31/34* (2006.01)

(52) U.S. Cl. ..... 423/440; 419/18

(58) Field of Classification Search ..... 423/439, 423/440; 419/14, 17, 18; 75/236, 241
See application file for complete search history.

(56) References Cited

U.S. PATENT DOCUMENTS 4,008,090 A * 2/1977 Miyake et al. ..... 501/91
5,567,662 A * 10/1996 Dunmead et al. ..... 501/87
5,993,730 A 11/1999 Waldenstrom et al.
6,254,658 B1 7/2001 Taniuchi et al.
2002/0043130 A1 4/2002 Kim et al.

FOREIGN PATENT DOCUMENTS

JP 10-212165 8/1998
WO 99-13120 3/1999

OTHER PUBLICATIONS

Bock et al.; "Inhibition of Grain Growth on Submicron Cemented Carbides"; Powder Metallurgy; Feb. 1, 1992; pp. 20-26; vol. 24, No. 1.
Swedish Office Action dated Feb. 11, 2004, citing no prior art.
Gerhard Gille et al., "Sintering Behaviour and Properties of WC-Co Hardmetals in Relation to the WC Powder Properties" *Euro PM'96 Properties/Testing,* pp. 195-211.

* cited by examiner

*Primary Examiner*—Timothy C. Vanoy
*Assistant Examiner*—James Fiorito
(74) *Attorney, Agent, or Firm*—Drinker Biddle & Reath LLP

(57) ABSTRACT

The present invention relates to a method of making tungsten carbide powder by dissolving at least one organic or inorganic metal salt or compound of at least one of the groups IV, V, and VI of the periodic system preferably Cr, V, Mo and W in at least one polar solvent. Powder of $WO_3$ is added to the solution, the solvent is evaporated, the remaining powder is heat treated in reducing atmosphere, mixed with carbon and carburized.

4 Claims, 3 Drawing Sheets

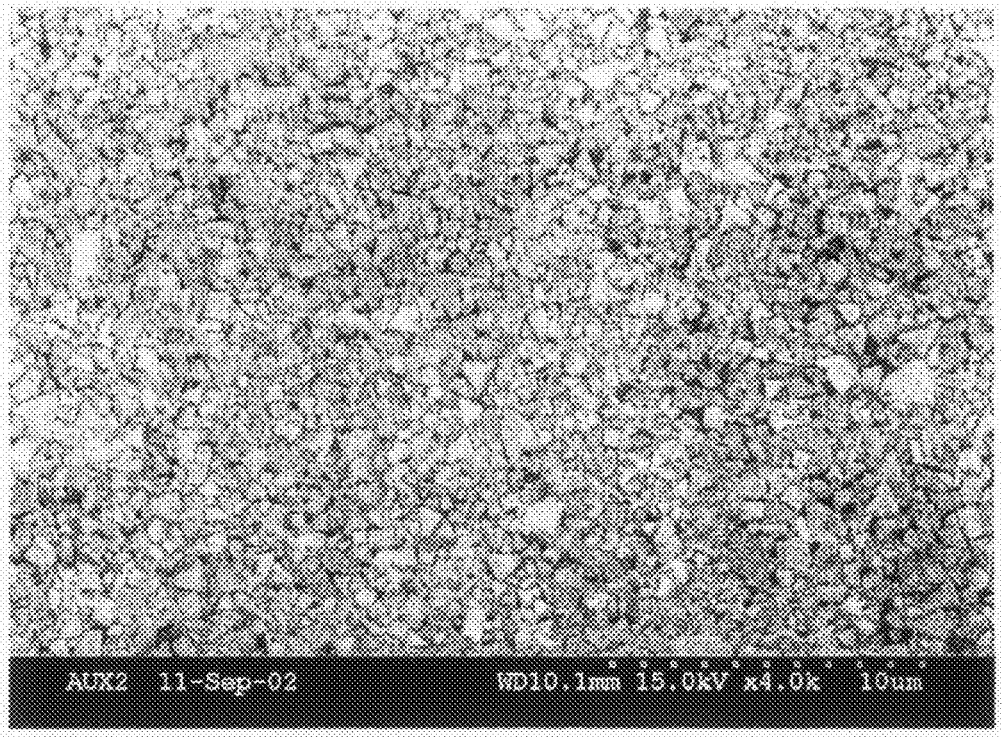
Fig. 1 x4000

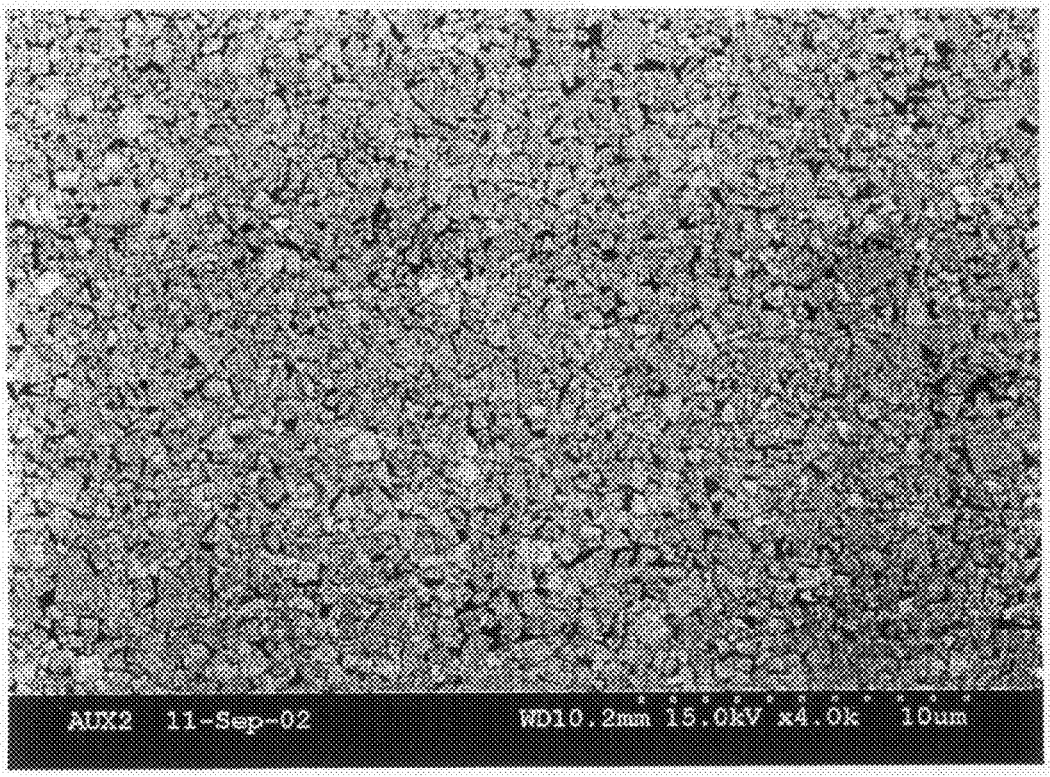
Fig. 2 x4000

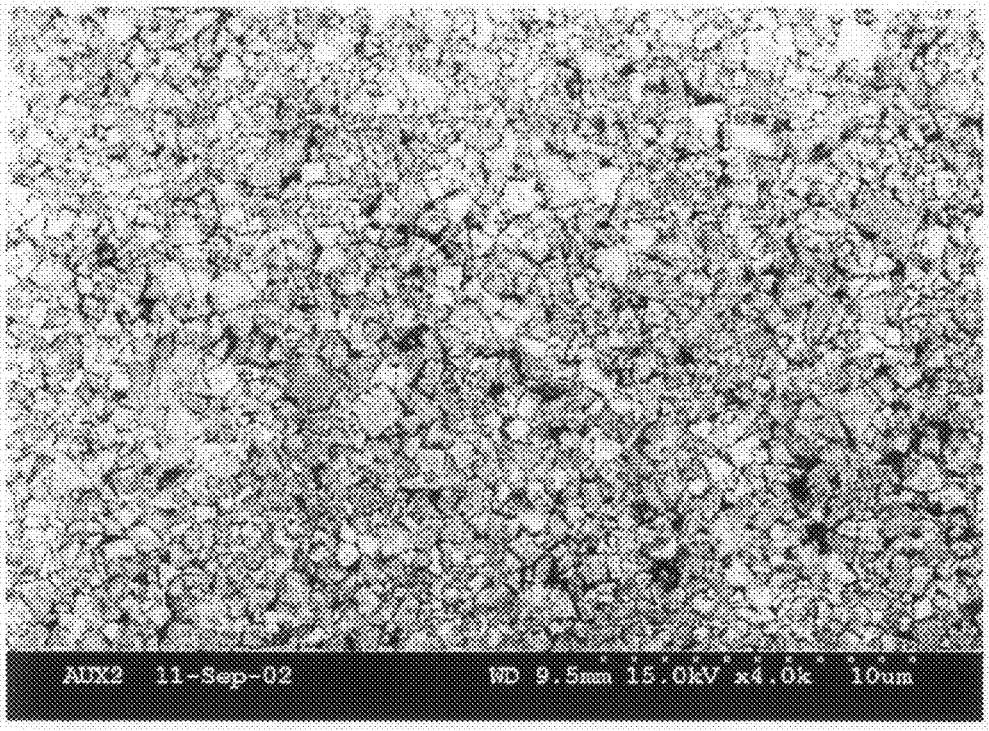
Fig. 3 x4000

METHOD OF MAKING SUBMICRON CEMENTED CARBIDE

BACKGROUND OF THE INVENTION

The present invention relates to a method of making submicron cemented carbide with extremely narrow grain size distribution.

Cemented carbide inserts with a grain refined structure are today used to a great extent for machining of steel, stainless steels and heat resistant alloys in applications with high demands on both toughness and wear resistance. Another important application is in micro drills for the machining of printed circuit board so called PCB-drills.

Common grain growth inhibitors include vanadium, chromium, tantalum, niobium and/or titanium or compounds involving these elements. When added, generally as carbides, they limit grain growth during sintering, but they also have undesirable side effects, affecting the toughness behavior in an unfavorable direction. Additions of vanadium or chromium are particularly detrimental and have to be kept on a very low level in order to limit their negative influence on the sintering behavior. Both vanadium and chromium reduce the sintering activity often resulting in an uneven binder phase distribution and toughness reducing defects in the sintered structure. Large additions are also known to result in precipitation of embrittling phases in the WC/Co grain boundaries. According to WO 99/13120, the amount of grain growth inhibitors can be reduced if a carbon content of the cemented carbide close to eta-phase formation is chosen.

Grain growth inhibitors limit the grain growth during sintering. However, since they generally are introduced in powder form their distribution is not as even as desirable. As a result in the sintered structure there often appear areas with abnormal grains of WC. A solution to this problem is disclosed in U.S. Pat. No. 5,993,730 according to which the WC grains are coated with Cr prior to the mixing operation. In this way the number of areas with abnormal grain growth can be reduced. However, larger grains from the original powder still remain in the sintered structure. The grains result from grain growth during the carburization operation. A solution to the problem is disclosed in JP-A-10-212165 in which tungsten oxide powder is mixed with powder of chromium oxide or chromium metal, reduced in hydrogen mixed with carbon powder and carburized to WC. Again because of the uneven distribution of the chromium a certain grain growth during carburization can not be avoided.

OBJECTS AND SUMMARY OF THE INVENTION

It is an object of the present invention to avoid or alleviate the problems of the prior art.

It is further an object of the present invention to provide a method of making a WC-powder with an extremely narrow grain size distribution.

There is provided a method of making tungsten carbide powder comprising dissolving at least one organic or inorganic metal salt or compound of at least one of the groups IV, V, and VI of the periodic system in at least one polar solvent, adding $WO_3$ powder to the solution, evaporating the solvent, heat treating the remaining powder in a reducing atmosphere, mixing the obtained powder with carbon and carburizing.

BRIEF DESCRIPTION OF THE FIGURES

FIG. 1 illustrates in about 4000× a typical microstructure of a WC—Co cemented carbide made with a WC-powder produced according to the invention.

FIGS. 2 and 3 illustrates in about 4000× a typical microstructure of the same cemented carbide grade produced from WC-powder according to prior art.

DETAILED DESCRIPTION OF THE INVENTION

It has now surprisingly been found that a WC-powder with an extremely narrow grain size distribution can be obtained if the $WO_3$-powder is coated with Cr prior to reduction and carburization.

According to the method of the present invention one or more organic or inorganic metal salts or compounds of at least one of the groups IV, V and VI of the periodic system particularly Cr, V, Mo, W, most preferably Cr and V are dissolved in at least one polar solvent such as ethanol, methanol and water. Powder of $WO_3$ is added to the solution. The solvent is evaporated and remaining powder is heat treated in reducing atmosphere, mixed with carbon and carburized to WC with a narrow grain size distribution. As a result a coated hard constituent WC powder is obtained, which after addition of pressing agent alone or optionally with other coated hard constituent powders and/or binder phase metals can be compacted and sintered according to standard practice.

In a preferred embodiment, chromium (III)nitrate 9-hydrate, ($Cr(NO_3)_3 \times 9H_2O$) or ammonium vanadate ($NH_4VO_3$), is dissolved in a suitable solvent such as 10% water and 90% ethanol ($C_2H_5OH$). $WO_3$ is added to the solution under stirring and dried in an evaporator. The dried mixture is reduced to W-metal in hydrogen, mixed with carbon and carburized to WC.

The invention is additionally illustrated in connection with the following Examples, which are to be considered as illustrative of the present invention. It should be understood, however, that the invention is not limited to the specific details of the Examples.

EXAMPLE 1

Invention

A submicron WC-10% Co-0.4% Cr cemented carbide was made in the following way according to the invention: 56.5 g chromium (III)nitrate-9-hydrate ($Cr(NO_3)_3 \times 9H_2O$) was dissolved in 100 ml water and 900 ml ethanol ($C_2H_5OH$). To this solution was added 2000 g tungsten trioxide ($WO_3$). The milling was carried out in a 2.4 liter ball mill with 2000 g milling balls and the milling time was 120 minutes. The mixture was heated up in vacuum and the temperature was increased to about 70° C. Careful stirring took place continuously during the time the water-ethanol solution was evaporating until the mixture had become dry.

The powder obtained was fired in a continuous laboratory reduction furnace in a porous bed about 2 mm thick in dry hydrogen atmosphere (dew point <−60° C.), heating rate about 30° C./min, reduction in hydrogen for 115 minutes at 700° C. completed by further reduction for 115 minutes at 900° C., finally followed by cooling in hydrogen atmosphere at about 30° C./min.

The tungsten powder obtained was mixed with carbon black to over-stoichiometric composition (6.25 weight-% C) and homogenized in a 2.4 liter ball mill. Ratio milling balls to powder weight: 1/1. Milling time: 180 min. The powder mixture was burnt off in hydrogen atmosphere in a laboratory carburizing furnace at 1350° C. for 150 minutes. Heating rate: 30° C./min and cooling rate: 45° C./min.

The powder obtained was mixed with pressing agent and Co-binder (Co-powder extra fine) in ethanol and adjustment of carbon content (carbon black), dried, compacted and sintered according to standard practice for WC—Co alloys. A dense cemented carbide structure with porosity A00 and hardness HV3=1665 was obtained. A submicron microstructure with a narrow grain size distribution as illustrated in FIG. 1 was obtained.

EXAMPLE 2

Invention

A submicron WC-10% Co-0.2% V cemented carbide was made in the following way according to the invention: 4.4 g ammonium vanadate ($NH_4VO_3$) was dissolved in 100 ml water and 900 ml ethanol ($C_2H_5OH$). To this solution was added 1000 g tungsten trioxide ($WO_3$) The milling was carried out in a 2.4 liter ball mill with 1000 g milling balls and the milling time was 120 minutes. All other steps was made in the same way as in Example 1. A dense cemented carbide structure with porosity A00 and hardness HV3=1680 was obtained. A submicron microstructure with a narrow grain size distribution similar to FIG. 1 was obtained.

EXAMPLE 3

Prior Art

A WC-10% Co-0.4% Cr cemented carbide was made in the following way according to patent U.S. Pat. No. 5,993,730: 23 g chromium (III)nitrate-9-hydrate ($Cr(NO_3)_3 \times 9H_2O$) was dissolved in 1700 ml methanol ($CH_3OH$). To this solution, 105 g triethanolamine ($(C_2H_5O)_3N$) was added during stirring. After that 686 g hexagonal WC ($d_{WC}$=0.6 μm) was added and the temperature was increased to about 70° C. Careful stirring took place continuously during the time the methanol was evaporating until the mixture had become viscous. The dough-like mixture was worked and crushed with a light pressure when it had become almost dry.

The powder obtained was fired in a furnace in a porous bed about 1 cm thick in nitrogen atmosphere in a closed vessel, heating rate 10° C./min to 550° C., completed with reduction in hydrogen for 90 minutes, finally followed by cooling in hydrogen atmosphere at 10° C./min. No cooling step between burning off and reduction step was used.

The powder obtained was mixed with pressing agent and Co-binder (Co-powder extra fine) in ethanol and adjustment of carbon content (carbon black), dried, compacted and sintered according to standard practice for WC—Co alloys. A dense cemented carbide structure with porosity A00 and hardness HV3=1670 was obtained. A submicron microstructure with about the same mean grain size but a somewhat broader grain size distribution compared to FIG. 1 as illustrated in FIG. 2 was obtained.

EXAMPLE 4

Prior Art

A WC-10% Co-0.4% Cr cemented carbide was made in the following way according to JP-A-10-212165: 2.7 g chromium trioxide ($Cr_2O_3$) was mixed up with 500 g tungsten trioxide ($WO_3$). The mixing was carried out in a 2.4 liter ball mill with 500 g milling balls and the milling time was 120 minutes.

The powder mixture was fired in a continues laboratory reduction furnace in a porous bed about 2 mm thick in dry hydrogen atmosphere (dew point <−60° C.), heating rate about 30° C./min, reduction in hydrogen for 115 minutes at 700° C. completed by further reduction for 115 minutes at 900° C., finally followed by cooling in hydrogen atmosphere at about 30° C./min.

The tungsten powder obtained was mixed with carbon black to over-stoichiometric composition (6.25 weight-% C) and homogenized in a 2.4 liter ball mill. Ratio milling balls to powder weight: 1/1.

Milling time: 180 min. The powder mixture was burnt off in hydrogen atmosphere in a laboratory carburizing furnace at 1350° C. for 150 minutes. Heating rate: 30° C./min and cooling rate: 45° C./min.

The powder obtained was mixed with pressing agent and Co-binder (Co-powder extra fine) in ethanol and adjustment of carbon content (carbon black), dried, compacted and sintered according to standard practice for WC—Co alloys. A dense cemented carbide structure with porosity A00 and hardness HV3=1620 was obtained. A submicron microstructure with about the same mean grain size but broader grain size distribution compared to FIGS. 1 to 2 as illustrated in FIG. 3 was obtained.

The principles, preferred embodiments, and modes of operation of the present invention have been described in the foregoing specification. The invention, which is intended to be protected herein, however, is not to be construed as limited to the particular forms disclosed, since these are to be regarded as illustrative rather than restrictive. Variations and changes may be made by those skilled in the art without departing from the spirit of the invention.

The invention claimed is:

1. Method of making tungsten carbide powder comprising dissolving at least one organic or inorganic metal salt of vanadium or compound of vanadium in at least one polar solvent, adding $WO_3$ powder to the solution, evaporating the solvent, heat treating the remaining powder in a reducing atmosphere to produce W-metal powder and V-metal powder, mixing the obtained powders with carbon and carburizing at a temperature of about 1350° C., wherein the method obtains a grain size distribution of WC powder of about 1.0, where the grain size distribution (N) is determined by:

$$N = \frac{(d_{90} - d_{10})}{d_{50}}$$

where $d_x$ is the mean grain size at which or below which x wt-% of the WC falls.

2. The method of claim 1 wherein said inorganic metal salt of vanadium is ammonium vanadate ($NH_4VO_3$).

3. The method of claim 1 wherein mixing the obtained powders with carbon results in an over-stoichiometric composition in carbon.

4. The method of claim 3 wherein the over-stoichiometric composition is about 6.25 wt. % carbon.

* * * * *